United States Patent [19]

Pace

[11] Patent Number: 4,961,724

[45] Date of Patent: Oct. 9, 1990

[54] LOW SPEED PARTICLE CONCENTRATORS

[75] Inventor: Dan R. Pace, Halifax, Canada

[73] Assignee: Occam Marine Technologies Ltd., Halifax, Canada

[21] Appl. No.: 413,738

[22] Filed: Sep. 28, 1989

[30] Foreign Application Priority Data

Sep. 30, 1988 [CA] Canada ..... 579008

[51] Int. Cl.[5] ..... B04B 1/08

[52] U.S. Cl. ..... 494/68; 494/44; 494/83

[58] Field of Search ..... 494/60, 67, 68, 69, 494/70, 74, 82, 83, 44, 46; 210/781, 782; 422/72

[56] References Cited

U.S. PATENT DOCUMENTS

| | | | |
|---|---|---|---|
| 1,968,788 | 7/1934 | Tomlinson | 494/68 |
| 2,092,484 | 9/1937 | Tomlinson | 494/68 |
| 2,417,747 | 3/1947 | Flowers | 494/68 |
| 2,483,342 | 9/1949 | Henrard | 494/68 |
| 2,779,537 | 1/1957 | Madany | 494/60 |

*Primary Examiner*—Robert W. Jenkins

*Attorney, Agent, or Firm*—Jones, Tullar & Cooper

[57] ABSTRACT

A low speed decanting centrifuge for separating relatively large particulate material (e.g. yeast) from a feedstock is disclosed. The centrifuge is clamped to a container and the centrifuge housing is pressurized to, in turn, pressurize the container and force feedstock upwardly into the lower bowl of the centrifuge. A plurality of inverted frustoconical discs carry supernatant downwardly and inwardly for vertical transfer to a discharge chamber. Particulate matter is centrifugally discharged continuously between engageable surfaces of the lower bowl member and the upper bowl member. The invention provides for continuous recycle as the discharged particulate matter is returned under gravity to the container. The centrifuge is reasonably inexpensive to produce from lightweight materials since it is not subjected to the high stresses of high speed centrifuges. Also, by operating at low speeds, under 1000 r.p.m., there will be less cell compaction and damage to the particulate material than with high speed centrifuges.

15 Claims, 8 Drawing Sheets

LOW SPEED PARTICLE CONCENTRATORS

The present invention relates to a compact, inexpensive low speed centrifuge primarily useful to microbiologists.

BACKGROUND OF THE INVENTION

When attempting to separate particulate matter from a fluid, it is known that very small (slowly settling) particles are exponentially more difficult to separate by centrifugation than larger particles. Accordingly, most disc-type centrifuges are designed to spin at extremely high speeds in order to separate the smallest particles at a reasonable rate. High speeds mean high stress on the equipment and on the particulate matter being separated. On the other hand, it is not always necessary for a centrifuge to be capable of separating extremely small particulate matter, especially if the operator is only interested in larger material.

However, there has not been any consideration given in the past to a disc-type centrifuge dedicated to larger particle separation such that the centrifuge could operate at relatively low speeds, resulting in less stress on the equipment and permitting the utilization of less exotic construction material and techniques.

SUMMARY OF THE INVENTION

The centrifuge of the present invention is intended to satisfy the need indicated above. Smaller particles have been ignored, the centrifuge being designed for larger, easier to separate particles such as most yeast and phytoplankton. The centrifuge operates at low speeds (less than 1000 r.p.m.) and low cost materials such as plastics and aluminum can be used. The present invention follows from the principle that separators are often purchased for specific applications and as long as the processing rate is adequate, a microbiologist working with one material (e.g. yeast) will not mind if his separator is not suitable for other materials (e.g. bacteria).

Another advantage of low speed separation is that it permits constant, unrestricted (360 degree) recycle. High speed machines can only provide intermittent unrestricted recycle by means of a hydraulically operated bowl rim seal, or continuous restricted recycle by a plurality of orifices. The cost of continuous ejection of solids about the entire bowl circumference increases exponentially with speed and would be prohibitive in high speed separators unless the aperture was so narrow that cell disruption might occur in recycle. With this invention, the rotational speed is low and there is continuous recycle; thus the centrifugal process is gentler on living material than with high speed separators and there is no cell compaction.

Furthermore, the centrifuge of this invention can be combined with the culture vessel itself so that supernatant can be continuously removed and replaced with feedstock without disturbing the culture. When not separating, the machine can be used to stir the culture by running it on recycle at atmospheric pressure.

The advantages enumerated above are achieved with the present invention which provides a low speed decanting centrifuge assembly for separating particulate matter from a fluid held within a container comprising: a housing; means for mounting the housing on the container; lower bearing support means within the mounting means and carrying an upwardly and outwardly flaring frustoconical deflector member; an outer cylindrical member extending downwardly from the mounting means; an intermediate cylindrical member extending downwardly from the bearing support means and within the outer cylindrical member; circumferentially spaced apart vane means between the support and mounting means defining a gap therebetween; a lower bowl assembly including an upwardly and outwardly flaring lower bowl member affixed to a lower bearing member, an inner cylindrical member extending downwardly therefrom within the intermediate cylindrical member, and bearing means between the lower bearing member and the lower bearing support for rotatably and bearingly supporting the lower bowl assembly within the housing; a drive motor on top of the housing and having a drive shaft extending downwardly into the housing; a cylindrical transfer tube keyed to the drive shaft and extending further into the housing to within the lower bowl member; an assembly of upwardly and outwardly flaring vertically spaced apart frustoconical discs attached to the lower end of the transfer tube, the tube having upper discharge port means in an upper discharge chamber of the housing and lower inlet port means between adjacent ones of the discs; an upper bowl member having an outer rim engageable with an outer rim of the lower bowl member and defining a centrifuge chamber with the lower bowl member, the centrifuge chamber enclosing the discs; means adjustably biasing the upper bowl member towards the lower bowl member; and means for admitting a gas under pressure into the housing below the discharge chamber, the pressurized gas being admissable into the container at least through the annular passage defined between the outer and intermediate cylindrical members to pressurize the container and thereby drive fluid from the container into the centrifuge assembly upwardly via the inner cylindrical member.

DESCRIPTION OF THE PREFERRED EMBODIMENT STRUCTURE

Figure 1A:
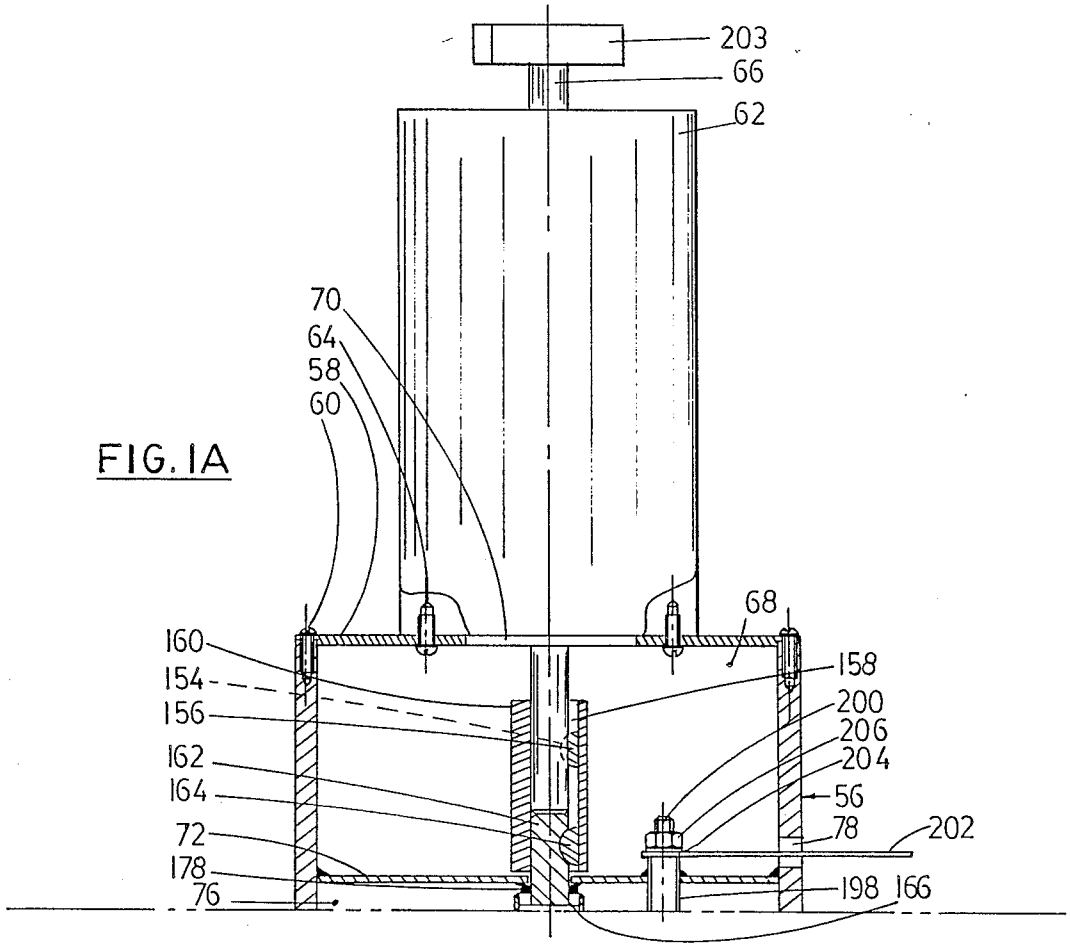
FIG. 1A B & C show a vertical cross-section through the decanting centrifuge of this invention.
Figure 1B:
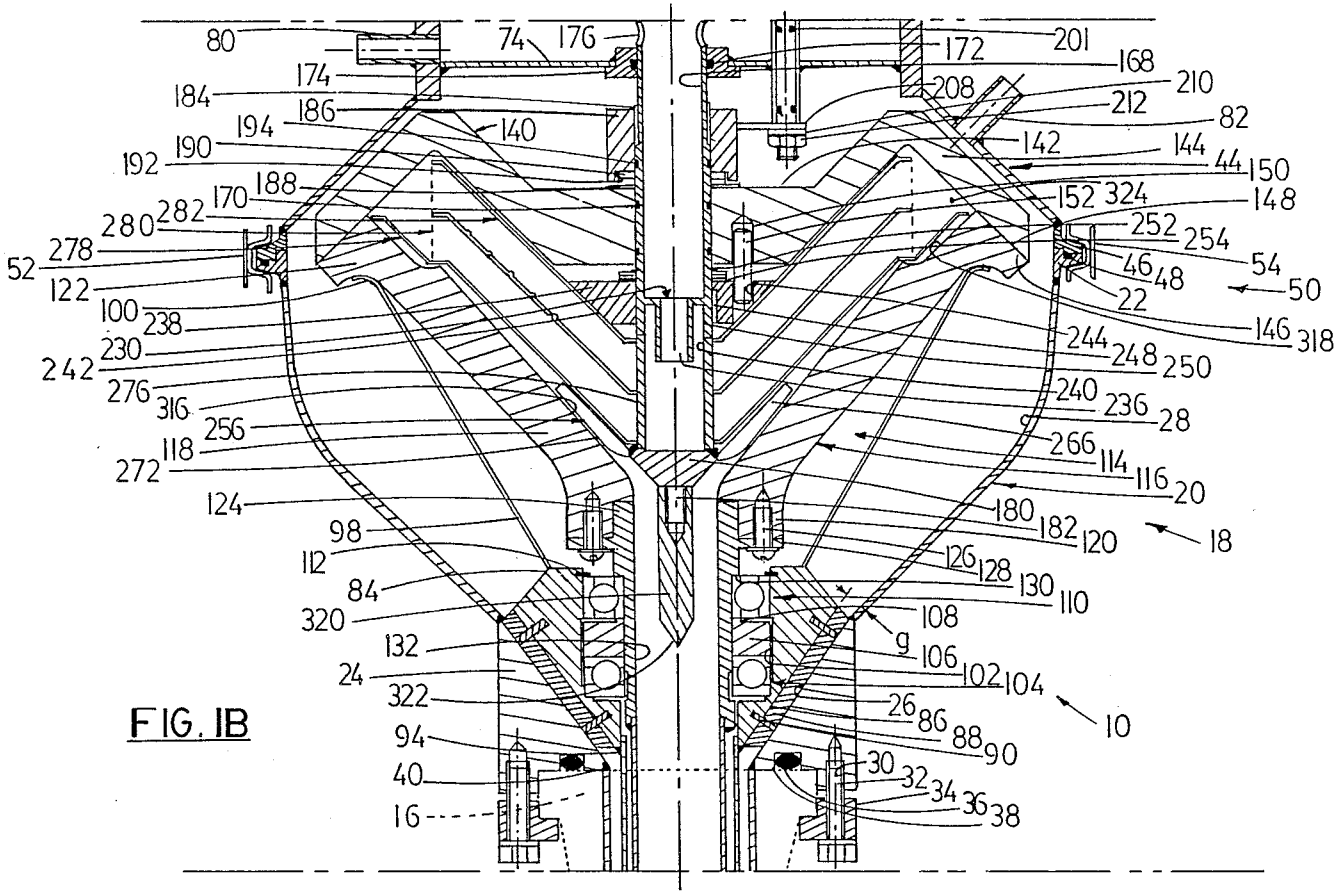
Figure 1C:
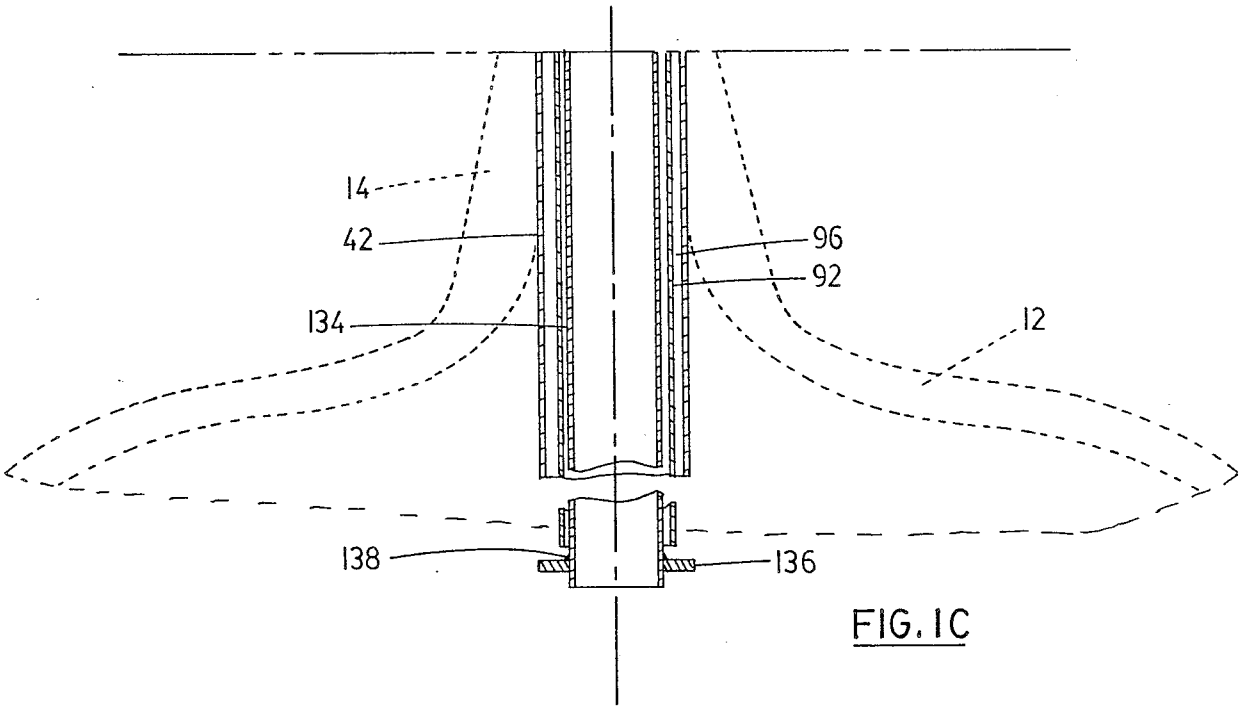

FIG. 1 illustrates in cross-section the major components of the decanting centrifuge of this invention. The centrifuge 10 is particularly designed for, but not restricted to, use with a container 12 having an upwardly-extending cylindrical neck 14 with a peripherally flanged rim 16 at the top thereof.

The centrifuge includes a housing 18 which is composed of a lower upwardly-opening bowl-like member 20 having an upper peripheral rim 22 and an annular lower mounting member 24 for attachment to the container 12. The mounting member is generally triangular in radial cross-section with the inner surface 26 thereof being generally an extension of the inner surface 28 of the lower housing member 20. A plurality of circumferentially spaced threaded bores 30 in the base of the mounting member 24 receive threaded bolts 32 which, in turn hold sections of an L-shaped retaining ring 34 against the underside of container rim 16 so as to clamp the housing to the container. An annular O-ring 36 is held in an annular recess or groove 38 in the base of the mounting member 24 to seal the mounting member to the container.

Welded to the inner circular edge 40 of the mounting member 24 is a downwardly depending outer cylindrical member 42 having an outer diameter approximately equal to the inner diameter of the container neck 14. With the lower housing clamped to the rim 16 the outer cylindrical member 42 will extend into the container. The member 42 could terminate just inside the container or, if deemed desirable, it could extend further into the container perhaps almost to the bottom thereof.

The housing 18 also includes an upper inwardly flaring frustoconical member 44 having a lower circumferential rim 46 which is shaped for an interlocking fit with upper rim 22 of the lower housing member 18. One or both of the rims 22, 46 is grooved so as to receive an O-ring 48 and an annular retainer 50 is provided to secure the housing members 18, 44 together. Retainer 50 includes an annular, generally V-shaped clamp 52 which is adapted to bear against both rims 22, 46 and an outer clamp 54, such as a hose clamp or similar device for applying a peripheral clamping force to the V-clamp 52. Such retaining structure as described herein is commercially available.

The upper circular portion of the member 44 has welded thereto a cylindrical casing 56 which in turn has a motor mounting plate 58 attached to the upper end thereof by way of circumferentially spaced machine screws 60. A D.C. motor 62 is attached to plate 58 via machine screws 64 and the drive shaft 66 thereof extends downwardly into an upper drive chamber 68 through a circular opening 70 in the plate 58.

Drive chamber 68 is defined between mounting plate 58 and a first dividing plate 72 which spans and is welded to the interior of the casing 56. A second dividing plate 74 below the first plate 72 spans and is welded to the interior of casing 56 and defines, with the first plate 72, a discharge chamber 76.

Casing 56 is provided with a horizontal slot 78 above plate 72, spanning a small arc, say about 15°, of the casing side. Also, a discharge outlet port 80 is provided in the casing wall, in communication with the discharge chamber 76. Finally, a gas inlet port 82 is provided in the upwardly sloping wall of the upper frustoconical member 44. The purpose of the slot 78 and the parts 80, 82 will become more readily apparent hereinafter.

The foregoing has generally described the exterior aspects of the particle concentration of this invention. The interior aspects will now be described.

Within the lower casing or mounting member 24 is an annular lower bearing support member 84 having a frustoconical lower surface 86 parallel to the surface 26 of the mounting member 24. Attached to the surface 86 is a plurality, at least three, of radially projecting, circumferentially spaced, narrow rectangular vanes 88 secured to the bearing support member 84 by way of pins 90. The vanes 88 rest on the surface 26 and serve to space the bearing support member 84 away from the mounting member 24, defining a gap G therebetween.

An intermediate cylindrical member 92 is welded to the bearing support member 84 as at 94 and extends downwardly within the outer cylindrical member 42 so as to define an annular space 96 therebetween. Like member 42, the cylindrical member 92 can descend a short distance so that it just enters the container or it can extend downwardly a greater distance, perhaps almost to the bottom of the container. Preferably the member 92 will enter the container at least as far as the member 42.

A metallic, frustoconical thin deflector member 98 flares upwardly and outwardly from the top of the bearing support 84 and has an outwardly extending peripheral ip 100 at the top edge thereof. The function of the deflector member 98 will be discussed in greater detail hereinafter.

The bearing support 84 includes a counterbore 102 which receives a lower thrust ball bearing assembly 104, an annular bearing spacer 106 an upper radial ball bearing assembly 110 and a retaining ring 112, the last-mentioned item engaging in a complementary groove in the wall of bore 102 and serving to hold the bearings and spacer in place. Spacer 106 has a raised inner annular shoulder 108 which engages the inner race of bearing assembly 110 and thus takes the load off the outer race of that bearing assembly. There is a slight clearance between the outer surface of the spacer 106 and the counterbore 102 and the upper and lower races of the thrust bearing 104 are dissimilar in outer and inner diameters to permit gas to flow through the bearing assembly and purge any fluid which might enter the assembly.

Lower bowl assembly 114 includes a frustoconical bowl member 116 having upwardly and outwardly flaring wall 118, a downwardly extending annular hub 120 and an outwardly extending peripheral rim 122. The hub 120 is machined to receive the upper end of a bearing housing 124 which is attached to the hub 120 by machine screws 126 passing through a circumferential flange 128 of the bearing housing 124. The housing 124 has an annular shoulder 130 which rests on the inner race of the upper bearing assembly 110 and a cylindrical bearing portion 132 which engages the inner race of the upper bearing assembly 110 and the upper race of the lower bearing assembly 104 and the spacer 106. The bearing portion 132 extends below the lower bearing assembly 104 and has welded thereto an inner cylindrical member 134 which extends into the container 12 to a level just above the bottom of the container 12. An annular deflector plate 136 may be removably attached to the bottom of the inner member 134, the plate having an upwardly curving fillet potion 138 for increased surface contact with the member 134 and to provide a smooth interface with the outer wall of the inner cylindrical member 134. The plate 136 may extend radially beyond the intermediate member 92 if the intermediate member extends to a level just above the plate 136.

Upper bowl member 140 is positioned above the lower bowl member 116 and has an inner annular portion 142 and an outer portion 144 which has a generally inverted V-shape in cross-section. The portion 144 has an outer annular surface 146 which is sealingly engageable with an upper annular surface 148 of the rim 122 of the lower bowl member 116. Preferably, the surfaces 146, 148 will be generally parallel to the outer, downwardly sloping wall of outer portion 144 although they could also be normal to the central axis A of the centrifuge. A bore 150 extends upwardly into the inner portion 142 of the upper bowl member 140, from the bottom surface thereof, and receives the upper portion of a cylindrical drive pin 152.

As indicated previously, drive shaft 66 extends downwardly from motor 62 into drive chamber 68. Shaft 66 has a keyway 154 which receives a woodruff key 156. That key engages a keyway 158 in a cylindrical drive coupling or motor alignment bushing 160, which bushing receives the shaft 66 therein. A cylindrical transfer shaft 162 has its upper end received in bushing 160, the shaft 162 being keyed to the bushing for rotation therewith by a woodruff key 164 which is bonded to the bushing 160, thereby permitting easy removal of the motor. Shaft 162 extends downwardly through the first dividing plate 72 and terminates at an enlarged annular shoulder defining an end cap 166.

Extending from the shaft 162 is a cylindrical transfer tube 168 which extends from below the first dividing plate 72 to below the central portion 142 of the upper bowl member 140. Two O-rings 170 seal the tube 168 to the upper bowl member 140 and a gas seal 172 seals the tube with respect to a bushing 174 welded to the second dividing plate 74. In the discharge chamber 76 the transfer tube is provided with a plurality of circumferentially spaced discharge openings. 176. At the upper end of the tube 168 the annular cap 166 is welded thereto and a V-ring seal 178 is positioned between the cap 166 and the underside of the first dividing plate 72, seal 178 also surrounding the transfer shaft 162. At its lower end (opposite transfer shaft 162) the tube 168 is welded to a generally frustoconical head member 180 which, in turn has a threaded shank 182 projecting axially therefrom.

In the area between the dividing plate 74 and the upper bowl member 140 the tube 168 is externally threaded as at 184 and an internally threaded adjusting nut 186 is engaged therewith. A washer 188 rests on the upper bowl member 140 and a wave spring 190 is positioned between the washer 188 and a counterbore 192 in the bottom of the nut 186. Spring 190 applies a downwards bias on the upper bowl member 140 against the adjusting nut 186. An O-ring 194 seals the transfer tube 168 to the axial bore of the adjusting nut.

Figure 2:
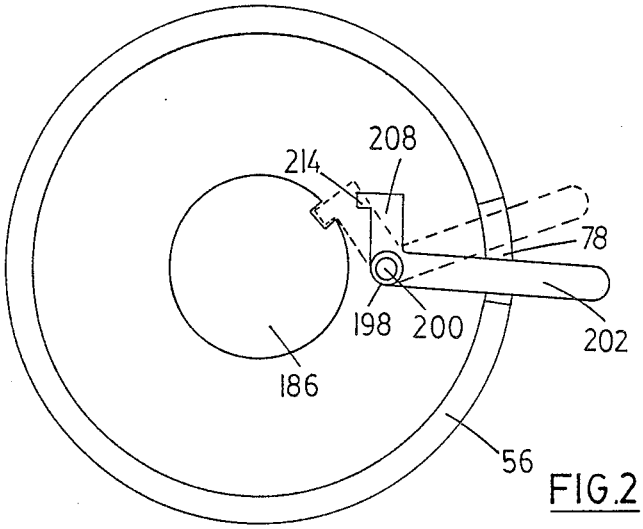
FIG. 2 illustrates, in plan, the operation of the adjusting nut used with the invention.

As seen in FIG. 2, the adjusting nut 186 has a rectangular recess 196 in the upper side wall thereof.

Extending downwardly through the upper and lower dividing walls 72, 74 and welded thereto is a transfer tube 198. A transfer shaft 200, threaded at each end extends through the tube 198 with an O-ring 201 sealing the shaft with respect to the tube 198. A lever 202 is attached to the shaft 200 at the upper end thereof via washer 204 and nut 206, the lever being conventionally keyed to the shaft 200 and projecting radially of the shaft outwardly through the slot 78 in the casing 56 (see FIG. 2). At the lower end of the shaft 200 a locking lever 208 is keyed thereto and secured via washer 210 and nut 212. The lever 208 is angled relative to lever 202 and has a projection 214 at its free end. When the lever 202 is rotated from the solid-line position shown in FIG. 2 to the dotted-line position the projection 214 will be brought into engagement with the recess 196 in the adjusting nut 186 so as to prevent rotation of nut 186 while the tube 168 is rotated manually via the distal end of shaft 66. The relative rotation between tube 168 and nut 186 causes the nut to travel along the tube 168 thereby altering the gap between the nut and the upper bowl member and hence the degree of possible separation between the upper and lower bowl members. An adjustment wheel 203, may be provided above the motor 62 to effect the desired rotation of shaft 66 and tube 168. With the locking levers 202, 208 in the solid-line position of FIG. 2 the nut 186 rotates along with the tube 168.

The structure within the upper and lower bowl members 140, 116 will now be described with reference to FIGS. 1 and 3 to 10.

Figure 3:
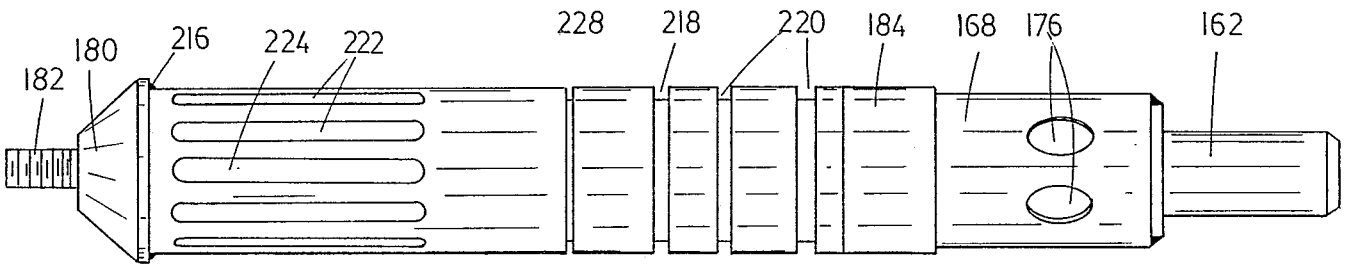
FIG. 3 shows the transfer tube used with the invention and FIG. 4 is a longitudinal section through the tube.
Figure 4:
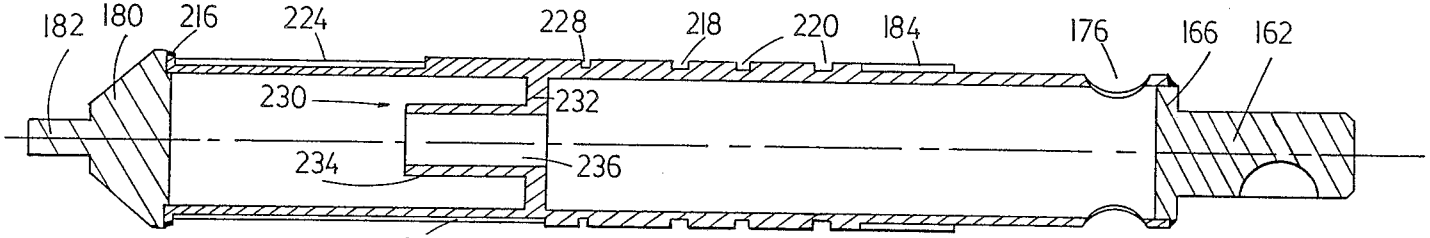

With particular reference first of all to FIGS. 3 and 4 further details of the transfer tube 168 will be described. It will be noted for example from FIG. 4 that the tube 168 is welded to the enlarged head 180 as at 216 so that the shaft 162, the head 180 and the transfer tube 168 will rotate together as the shaft 162 is rotated by the motor 62. Also shown in FIGS. 3 and 4 are the circumferential grooves 218, 218, 220 which receive the O-rings 170, 170, 194 respectively, the circumferentially spaced openings 176 and the external threads 184 to which the adjusting nut 186 is threaded.

At its lower end, closer to the head 180 the tube 168 is provided with a plurality of circumferentially spaced, axially extending, round ended slots 222, which slots are located circumferentially between a pair of diametrically opposed, axially extending keyways 224, 226. As seen best in FIG. 4 the keyway 226 is longer than the keyway 224, extending away from head 180 almost to a narrow circumferential groove 228.

Internally, the tube 168 is provided with an integral sill 230 which includes an annular internal flange 232 and an axially downwardly extending cylindrical tube 234 defining an axial passage 236. The purpose of the sill 230 will become apparent hereinafter.

With reference again to FIG. 1 there will be seen an upper disc support member 238 having a through bore 240 receiving the tube 168 and an outer downwardly and inwardly sloping surface 242. An axially extending counterbore 244 receives the drive pin 152, which pin is also received in the counterbore 150 in the upper bowl member 140 such that the members 140, 238 can rotate together. Furthermore, the member 238 has an axially extending keyway 248 in the bore 240 such that a key 250 is receivable therein as well as in the keyway 226, thereby keying the member 238 to the transfer tube 168.

Above the disc support member 238 a circlip or retainer ring 252, received in groove 228 of transfer tube 168, holds a wave spring 254 against the upper surface of the disc support member 238. The spring 254 applies a downwards bias against the disc support member 238.

Figure 5:
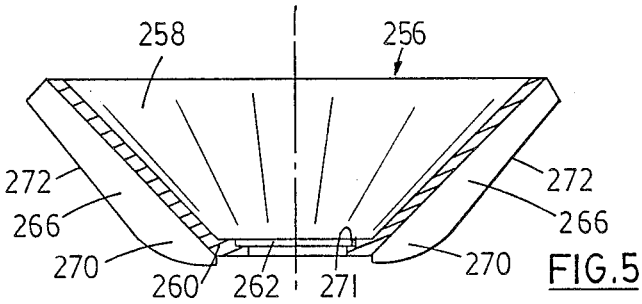
FIGS. 5 and 6 show a longitudinal section and a plan view of the lower disc support of this invention.
Figure 6:
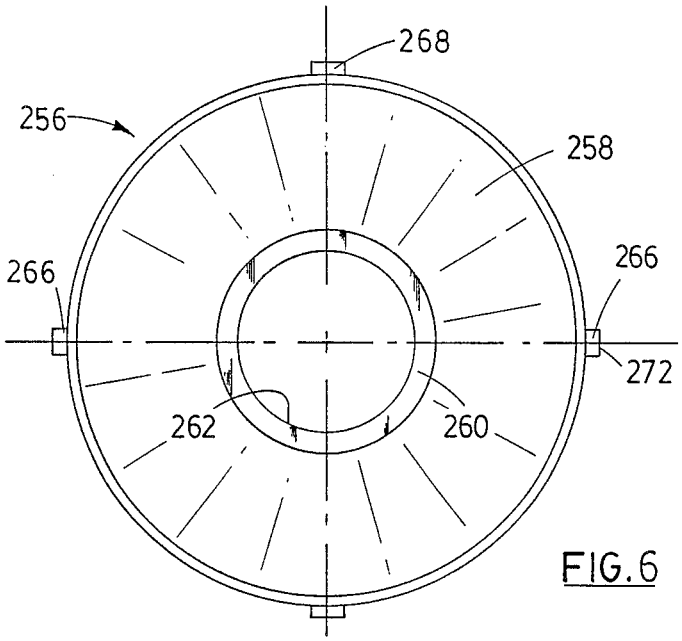

FIGS. 1, 5 and 6 illustrate a lower disc support member 256 which rests on the head 180. The member 256 includes upwardly and outwardly flaring frustoconical wall 258, which wall starts from a narrow lower annular flange 260. The flange has a central opening 262 through which the transfer tube 168 can pass.

Two pairs of diametrically opposed vanes 266, 268 are provided on the outer surface of the wall 258 so as to extend the height thereof, with a portion 270 of each projecting below the bottom surface of flange 260. As seen in FIG. 1, there is a small clearance between the outer edge 272 of each vane 266, 268 and the inner surface 276 of the lower bowl member 116.

With reference now to FIGS. 1 and 7 to 10, the remaining structural features of the present invention will be described. In particular it will be seen from FIG. 1 that there is a plurality of separator discs 278, 280, 282 positioned between the lower and upper disc supports 256, 238. There is a single lowermost disc 278, a plurality of intermediate discs 280 and a single uppermost disc 282. The discs 278, 280, 282 are shown more completely in FIGS. 7 to 12.

Figure 7:
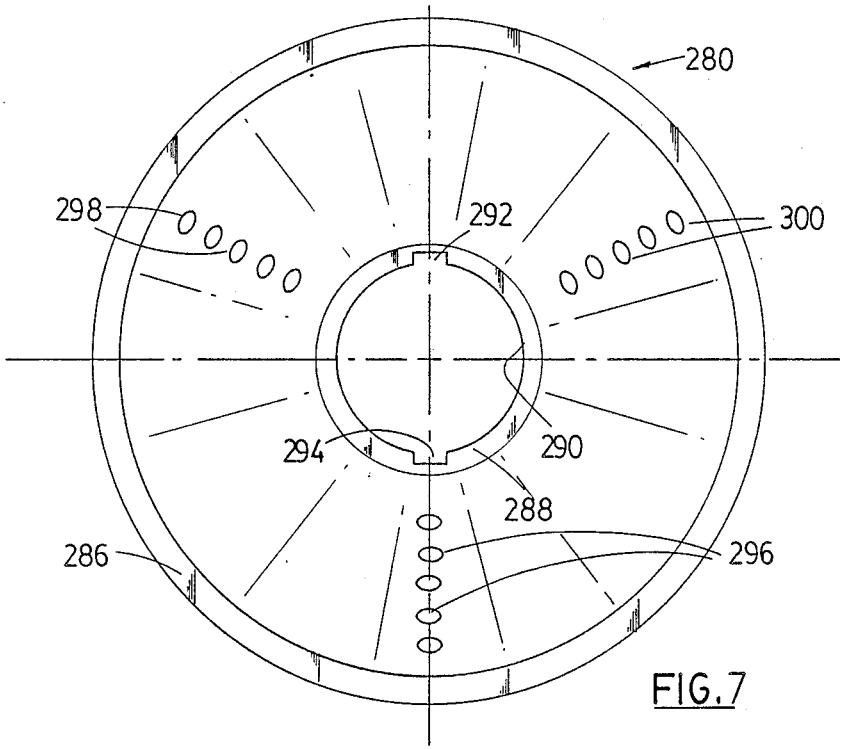
FIGS. 7 and 8 show a plan view and a longitudinal section of a disc member.
Figure 8:
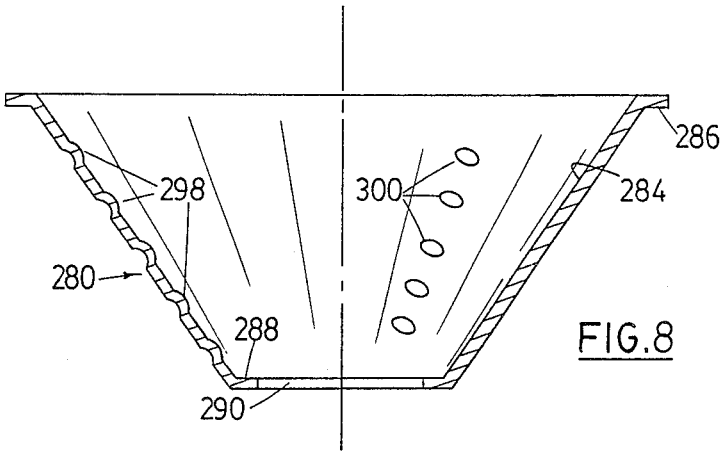

The separator discs 280 are best seen in FIGS. 7 and 8. Since the discs 280 are identical to each other, only one will be described, it being noted that the disc includes a frustoconical wall 284 with an outwardly projecting annular rim 286 at the upper, or largest diameter, end. At the lower, or small diameter end there is an inwardly directed annular flange 288 defining a central opening 290 and a pair of diametrically opposed slots or keyway 292, 294. The opening 290 is of a size to receive the transfer tube 168 and the keyways are alignable with the keyways 224, 226 in the tube 168.

The disc 280 is may be formed from anodized aluminum and, radially aligned with one of the keyways 294, there is a linear series of generally hemispherical dimples 296 formed in the wall 284 so as to project into the interior of the disc. Two other radially aligned series of dimples 298, 300 project into the interior of the disc along lines offset from the line of dimples 296 by about 120°.

Figure 10:
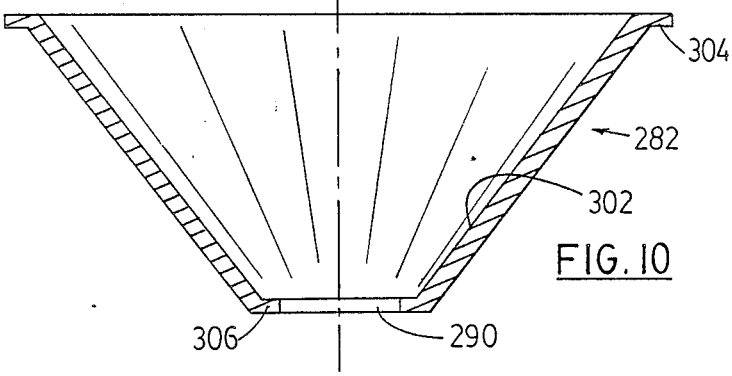
FIGS. 9 and 10 show a plan view and a longitudinal section of the upper disc member.
Figure 9:
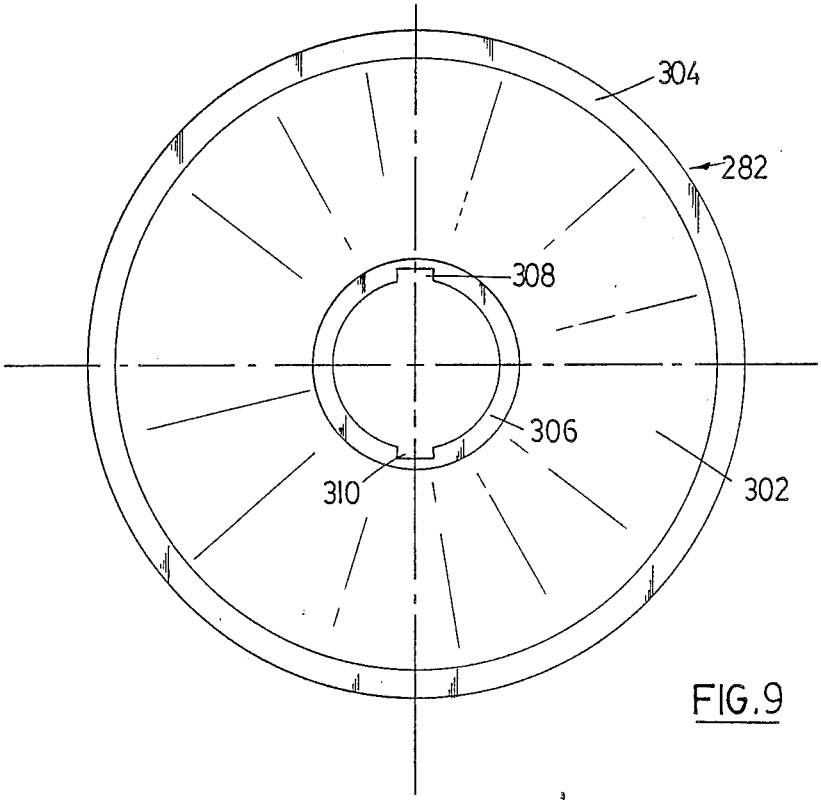

With reference to FIGS. 9 and 10, it will be seen that the upper disc 282 is essentially the same as the discs 280 except that it does not have any dimples therein. Thus, the frustoconical wall 302 of the disc 282 is smooth. The disc 282 has a rim 304, flange 306 and keyway slots 308, 310 which are analogous to the rim 286, flange 288 and keyway slots 292, 294 of the disc 280.

Figure 11:
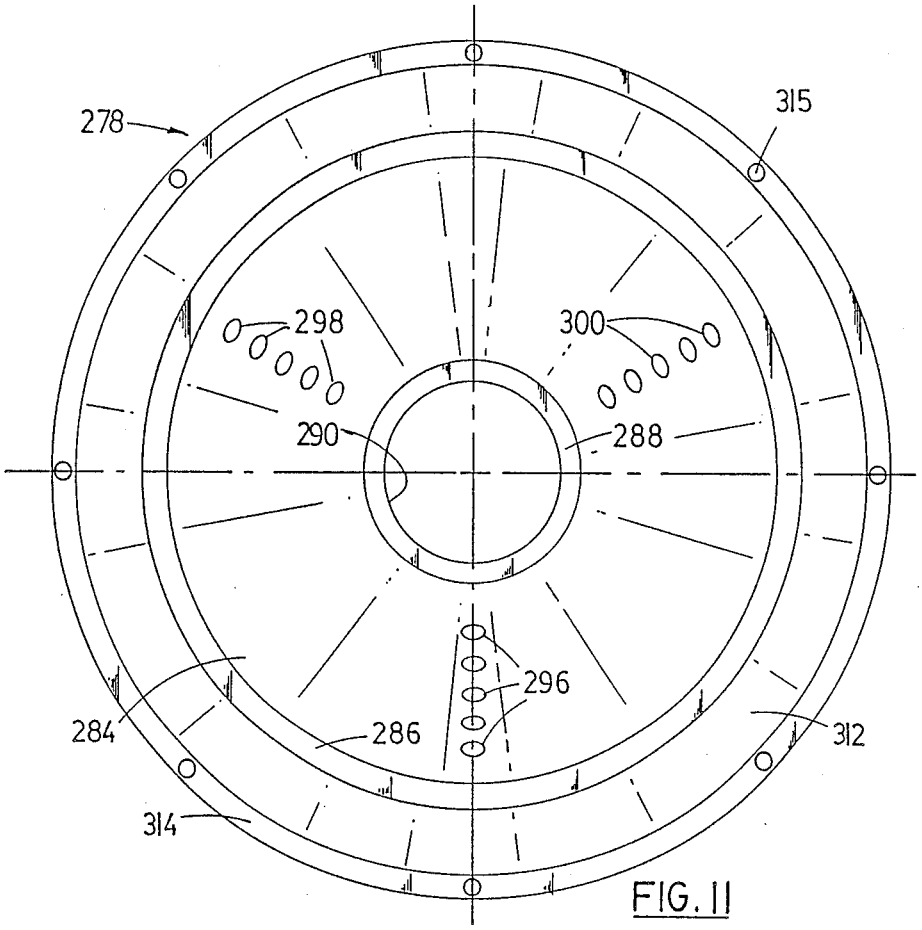
FIGS. 11 and 12 show a plan view and a longitudinal section of the lowermost disc member.
Figure 12:
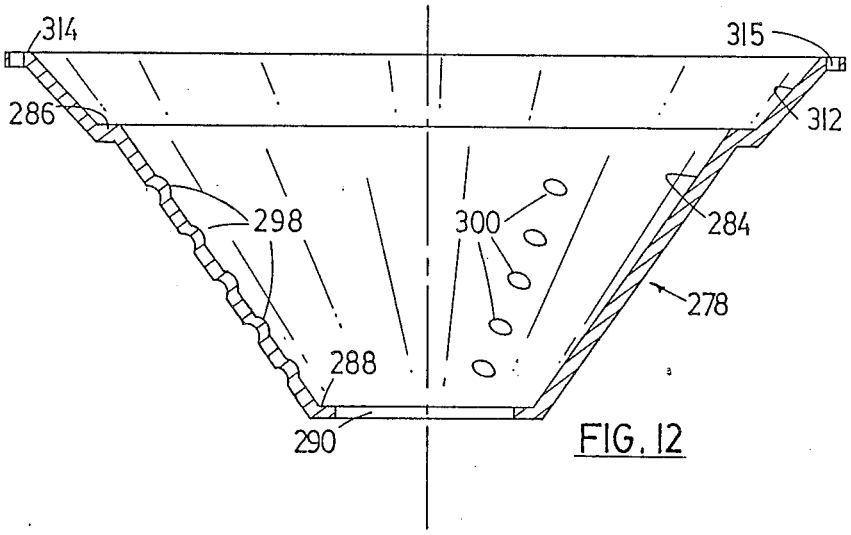

With reference to FIGS. 1, 11 and 12 it will be seen that the disc 278 is identical to the disc 280 except that it lacks keyways 292, 294 and it includes an upwardly and outwardly flaring wall portion 312 which extends upwardly from the outer edge of rim 286 and which has an outer rim 314 at the upper edge thereof. A plurality of circumferentially spaced circular feed ports or holes 315 may be provided through or near the outer rim 314 of the lowermost disc 278.

When assembling discs to achieve the configuration of FIG. 1, one first of all slides the lower disc support member 256 down over the tube 168 with the tube 168 passing through the opening 262 and the flange 260 resting on the lower head 180 of the tube 168. If desired, an O-ring may be placed in a recess 271 in the upper portion of the disc support 256, on which the flange 288 will rest, (see FIG. 5) so as to prevent air from being drawn into the pump from the transfer tube. Alternatively, the lowermost disc 278 could be bonded to the disc support or it could even be moulded integrally with the disc support itself and sealed to the transfer tube 168. One then, inserts a key 316 in keyway 224 of transfer tube 168 and the key 250 in the keyway 226 of the transfer tube 168.

With the lower disc support member 256 in place, the lower disc 278 is placed over the tube 168 until its wall 284 rests on the inner wall 258 of the support member 256.

From FIG. 1, it is seen that the included cone angle of the support member 256 and of the disc 278 is greater than the included cone angle of the lower bowl member 116 so that the inner wall of the bowl member approaches the wall 284 of the disc 278 in the vicinity of the rim 286. The inner wall of the bowl member is circumferentially recessed as at 318 to accept the rim 286 in close juxtaposition thereto, the upper wall portion 312 of the disc member 278 being located within the recessed wall area 318.

Thereafter, one places on the tube 168 the plurality of discs 280 to achieve a build-up of vertically spaced apart discs 280 (due to the dimples 296, 298, 300) above the disc 278, all of the discs 278, 280 being keyed to the transfer tube via keys 250, 316. in order to effectively utilize the dimples 296, 298, 300 to space the walls 284 of the discs 278, 280 apart, one should ensure that the keyway slot 294 of successive discs is only engaged with one of the keys 250, 316 so that the dimples of each disc coincide with the dimples of the adjacent discs. This reduces the impact of the dimples on separation.

After the topmost disc 280 is assembled to the tube 168, the upper disc 282 is placed over the tube 168 and keyed thereto by engagement of the keyway slots 308, 310 with the keys 250, 316. The upper disc 282 rests on the dimples 296, 298, 300 of the uppermost disc 280. Then the upper disc support member 238 is assembled onto the tube 168 with the keyway slot 248 therein engaging the upper end of key 250. The wave spring 254 is placed on the tube 168 to rest on the upper surface of the upper disc support member and the circlip 252 is placed in the groove to clamp the members therebelow into a unitary rotatable assembly, one with the transfer tube 168.

Finally, a short length of shaft 320 may be threaded onto the threaded shank 182 of the head 180, the shaft 320 having a conical end 322 projecting into the innermost cylinder or tube 134. This shaft 320 promotes acceleration of the fluid and prevents cavitation.

OPERATION

With the decanting centrifuge of the present invention in position and locked to the neck 14 of a container 12, one, first of all, connects a source of pressurized gas, such as air, carbon dioxide, etcetera, (not shown) to the gas inlet port 82 in a conventional manner. Preferably the connection will be valved to control the pressure introduced into the centrifuge.

With the pressurized gas entering the centrifuge via port 82, the motor 62 is started and is controlled to rotate at a relatively low speed, preferably under 1000 r.p.m. The motor causes shaft 66 to rotate and that shaft in turn causes transfer bushing 160, transfer shaft 162 and transfer tube 168 to rotate. Furthermore, the upper bowl member 140 will rotate through its pinned connection to the upper disc support member 238 which is keyed to the transfer tube 168. Also, as the tube 168 rotates so will the discs 278, 280, 282 and the lower shaft 320.

In view of friction between the mating surfaces 146, 148 of the upper and lower bowl members 140, 116 initial rotation of the upper bowl member 140 will cause rotation of the lower bowl member 116 as well.

As the centrifuge operates, pressurized gas will pass via inlet port 82 into the interior between the bowl members 116, 140 and the outer casing members 18, 44. The pressuriZed gas will pass between the lower bearing support 84 and the mounting member 24, past the vanes 88 and along the annular passageway 96 defined between the outer and intermediate cylindrical members 42, 92 to pressurize the container 12. Gas also flows between the upper rim of deflector plate 98 and the lower bowl member 116, through the bearing assemblies 104, 110 and between the intermediate and inner cylindrical members 92, 134 to help pressurize the container. Since the centrifuge seals the neck 14 of the container 12, the fluid therein is forced to rise along the inner cylindrical member 134 until it reaches the lower shaft 320 which, through its rotation, imparts additional rotary movement to the rising fluid. Since the lower bowl member 116 is rotating, the inner cylindrical member 134 will also be rotating and thus the rising fluid will be rotating at a progressively greater speed as it rises in the member 134.

When the rising fluid reaches the head 180, it will move upwardly and outwardly along the inner wall of the lower bowl member 116, past the vanes 266 and between the inner wall of the lower bowl member 116 and the lowermost disc 278. The fluid will eventually reach the open annular area between the bowl members 116, 140 and the rims of the discs 280 and 282. As fluid continues to flow upwardly into the area 324, it will be forced to flow downwardly along the disc members 278, 280 and the particulate matter within the fluid will be accumulating within the area 324 under centrifugal forces. Separated fluid, containing little or no particulate matter will flow inwardly and downwardly along and between the discs 278, 280, 282 and then pass through the slots 222 into the interior of the transfer tube 168.

Separated fluid within the transfer tube 168 will be forced upwardly through the cylindrical passage 236 of the sill 230. The sill creates a degree of backpressure to ensure that separation of particulate matter will take place along all of the discs. Finally, the separated clean fluid will exit the openings 176 into the discharge chamber 76 and after sufficient fluid has accumulated therein, it will discharge through the outlet port 80 to be transferred to wherever the operator may desire.

As the fluids accumulates in the area 324 there will be sufficient upwards hydraulic pressure on the upper bowl member 140 to cause it to rise against the bias of wave spring 190 causing a small gap to appear between the mating surfaces 146, 148. Fluid containing a large proportion of particulate matter will exit the area 324 centrifugally between the surfaces 146, 148 and will fall downwardly along the essentially vertical inner wall of the outer housing member 20. This material is recycled to the container 12 under the influence of gravity. The separated material enters the container between the outer and intermediate cylindrical members 42 and 92.

Eventually, an equilibrium condition will be achieved with the fluid entering the centrifuge, separation occurring in the area 324, particulate matter exiting between the surfaces 146, 148 as the bowl members rotate and supernatant (separated fluid) exiting via the discharge port 80.

The maximum gap between the surfaces 146, 148 is adjustable by way of the adjusting nut 186 which defines a stop against which the upper bowl member 140 will abut when at its maximum open position. When it is necessary to alter the maximum opening between the surfaces 146, 148, the operator will stop the centrifuge and rotate lever arm 202 to bring projection 214 into contact with the adjusting nut 186. While applying a slight pressure to the lever arm the operator manually rotates the motor shaft 66 via adjustment wheel 203 until the projection locks in notch 196. The adjustment nut is now locked. By manually rotating the adjustment wheel 203, the gap between the bowl members may be opened or closed. To run the centrifuge, the lever arm 202 is swung to the solid line position of FIG. 2 and locked in this position by a recess in the housing wall 78. If the wheel 203 has a rim mark thereon and if the top of the motor is provided with degree markings (not shown), it is possible to gauge the extent of the gap.

The deflector 98 plays an important role in the present invention in that it helps to separate the gas flow from the recycle flow, thereby reducing foaming of the fluid. It also prevents the recycle fluid from flooding the bearings 104, 110 and it minimizes fluid drag on the rotating cylinder member 134.

During start-up, there is some gas leakage between the bowl members because the seal therebetween will probably not be perfect. Such flow or leakage is negligible compared to the unimpeded gas flow directly into the container. This strong disparity in gas flows allows the centrifuge to be primed by gas pressure; once primed, it is not essential to maintain gas pressure other than to drive the light phase discharge through outlet 80. However, one would probably maintain gas pressure within the centrifuge to reduce fluid drag and to partially counterbalance hydraulic pressure in the bowl, thereby reducing load on the bearings.

If, as suggested previously, one or both of the cylinder members 42, 92 terminates just inside the container, it is likely that foaming of the fluid within the container by the gas could be reduced. If the intermediate cylinder 92 and the inner cylinder 134 are of approximately equal length, extending towards the bottom of the container, it would be desirable to include a fluted steady bearing or a spider set (not shown) between the members just above the flange 130 to maintain the desired annular separation between the members during operation.

The centrifuge of this invention is designed to operate at a relatively low speed, less than 1000 r.p.m., and this enables the cost of materials to be less than for high speed centrifuges. The bowl member, the housing and perhaps even the discs may be plastic (e.g. polycarbonate) since the stresses on the components will be small. Furthermore, low speeds permit the maintenance of constant, unrestricted recycle. By being able to utilize continuous recycle, there will be little or no cell compaction in the area 324 and the centrifugal separation process is much gentler on living material than high speed centrifuges.

By combining the centrifuge 10 with the container 12 it is possible to continuously remove the supernatant and to replace the feedstock without disturbing the culture, a particular advantage for the microbiologist who is working with a yeast culture.

Clearly, the present invention provides a small, low cost decanting centrifuge which can be operated at low speeds, provides for continuous recycle and does not damage the particulate (cell) material being separated from the fluid (supernatant). The centrifuge of this invention has particular benefit to microbiologists who are desirous of separating relatively large material (e.g. yeast) and are not concerned with relatively small material (e.g. bacteria).

The present invention has been described with reference to a preferred embodiment thereof. It is understood however that modifications to the invention could be effected by a skilled person without departing from the basic concepts thereof. Accordingly, the protection to be afforded the present invention is to be determined from the claims appended hereto.

The embodiments of the invention in which an exclusive property or privilege is claimed are defined as follows:

1. A low speed decanting centrifuge assembly for separating particulate matter from a fluid held within a container comprising: a housing; means for mounting said housing on said container; lower bearing support means within said mounting means and carrying an upwardly and outwardly flaring frustoconical deflector member; an outer cylindrical member extending downwardly from said mounting means; an intermediate cylindrical member extending downwardly from said bearing support means and within said outer cylindrical member; circumferentially spaced apart vane means between said support and mounting means defining a gap therebetween; a lower bowl assembly including an upwardly and outwardly flaring lower bowl member affixed to a lower bearing member, an inner cylindrical member extending downwardly therefrom within said intermediate cylindrical member, and bearing means between said lower bearing member and said lower bearing support for rotatably and bearingly supporting said lower bowl assembly within said housing; a drive motor on top of said housing and having a drive shaft extending downwardly into said housing; a cylindrical transfer tube keyed to said drive shaft and extending further into said housing to within said lower bowl member; an assembly of upwardly and outwardly flaring vertically spaced apart frustoconical discs attached to the lower end of said transfer tube, said tube having upper discharge port means in an upper discharge chamber of said housing and lower inlet port means between adjacent ones of said discs; an upper bowl member having an outer rim engageable with an outer rim of said lower bowl member and defining a centrifuge chamber with said lower bowl member, said centrifuge chamber enclosing said discs; means adjustably biasing said upper bowl member towards said lower bowl member; and means for admitting a gas under pressure into said housing below said discharge chamber, said pressurized gas being admissable into said container at least through the annular passage defined between said outer and intermediate cylindrical members to pressurize said container and thereby drive fluid from said container into said centrifuge assembly upwardly via said inner cylindrical member.

2. The centrifuge assembly of claim 1 wherein said housing comprises: an upper inversely frustoconical section closely adjacent said upper bowl member with said means for admitting pressurized gas including an inlet port in said upper section; an upper cylindrical portion above said upper section and containing said discharge chamber with an outlet port leading therefrom, and an upper transfer chamber; a lower bowl section having downwardly extending sides and a lower portion connected to said mounting means; and clamping means hermetically sealing said upper section to said lower section along mating peripheral edges thereof.

3. The centrifuge assembly of claim 2 wherein said disc assembly includes a lower disc member, a plurality intermediate disc members and an upper disc member, each of said disc members having a lower annular flange for reception of said transfer tube therein, a frustoconical wall portion extending upwardly from said flange and a peripheral outwardly extending flange at the upper rim thereof.

4. The assembly of claim 3 wherein each of said intermediate disc members and said lower disc member includes a plurality of upwardly directed generally spherical dimples in the wall portion thereof, said dimples being arranged in circumferentially spaced radially directed lines along the radial length of the disc wall portion.

5. The centrifuge assembly of claim 4 wherein said upper bowl member includes an annular flat central section and a peripheral outer portion of inverted-V shape, the outer portion including a downwardly and outwardly flaring annular surface which is sealingly engageable with an upper annular surface of said lower bowl member.

6. The centrifuge assembly of claim 5, including an adjusting nut threaded to said transfer tube above the central section of said upper bowl member, annular spring means between said nut and the central section of said upper bowl member biasing said upper bowl member towards said lower bowl member, and means for setting said adjusting nut at a desired position.

7. The centrifuge assembly of claim 6 wherein said setting means includes a tubular bearing member extending from said upper transfer chamber to adjacent said nut, a shaft extending through said bearing member, a first lever secured to said shaft and extending radially away therefrom through a horizontal slot in the cylindrical upper housing portion, a second lever secured to said shaft and extending to closely adjacent said nut, said second lever having a projection thereon for engagement with a mating recess in said nut whereby movement of said first lever in one direction will move said projection into engagement with said recess and movement of the first lever in the opposite direction will release the projection from engagement with said recess.

8. The centrifuge assembly of claim 7 wherein an adjusting wheel is provided on said motor drivingly connected to said drive shaft for rotating said transfer tube relative to said adjusting nut when said projection is engaging said recess to increase or decrease the separation between said nut and said upper bowl member.

9. The assembly of claim 3 wherein said transfer tube includes a pair of diametrically opposed keyways extending along the lower portion thereof and wherein each of said intermediate and upper disc members includes a pair of diametrically opposed key slots in the annular flange for mating engagement with keys contained in said transfer tube keyways.

10. The centrifuge assembly of claim 3 including a frustoconical lower disc support member below said lower disc member and sealably engageable with said transfer tube, said lower disc support member including a plurality of radially extending vanes circumferentially spaced apart and extending downwardly to adjacent the inner wall of said lower bowl member.

11. The centrifuge assembly of claim 3 wherein said lower bowl member includes a peripherally recessed area adjacent the upper rim thereof and wherein said lower disc member includes an upper wall portion within said recessed area and extending upwardly and outwardly from the upper peripheral flange thereof, there being a second peripheral flange extending outwardly from said upper wall portion.

12. The centrifuge assembly of claim 3 wherein said lower bowl member includes a peripherally recessed area adjacent the upper rim thereof and wherein said lower disc member includes an upper wall portion within said recessed area and extending upwardly and outwardly from the upper peripheral flange thereof, there being a second peripheral flange extending outwardly from said upper wall portion.

13. The centrifuge assembly of claim 3 wherein said transfer tube includes sill means therein, said sill means including an inwardly extending annular flange and a cylindrical section extending from said annular flange towards the lower end of said transfer tube.

14. The centrifuge assembly of claim 3 including an upper disc support member below said upper bowl member, resting on said upper disc member and keyed to said transfer tube and connected to said upper bowl member.

15. The centrifuge assembly of claim 1 wherein said bearing means includes a lower thrust bearing assembly, an upper radial bearing assembly and annular spacer means separating said upper and lower bearing assemblies, pressurized gas also being admissable into said contain through said bearing means and the annular passage defined between said inner and intermediate cylindrical members.

* * * * *